US005089851A

United States Patent [19]

Tanaka et al.

[11] Patent Number: 5,089,851

[45] Date of Patent: Feb. 18, 1992

[54] CHARGING MEMBER

[75] Inventors: Hisami Tanaka, Yokohama; Masami Okunuki, Tokyo, both of Japan

[73] Assignee: Canon Kabushiki Kaisha, Tokyo, Japan

[21] Appl. No.: 310,281

[22] Filed: Feb. 14, 1989

[30] Foreign Application Priority Data

Feb. 19, 1988 [JP] Japan ..... 63-036911

[51] Int. Cl.[5] ..... G03G 15/02

[52] U.S. Cl. ..... 355/219; 361/225; 430/902

[58] Field of Search ..... 355/219, 274, 275; 361/220-225, 230, 232-234; 174/106 SC; 430/920

[56] References Cited

U.S. PATENT DOCUMENTS

| | | | |
|---|---|---|---|
| 3,626,260 | 12/1971 | Kimura et al. | 361/225 |
| 3,697,836 | 10/1972 | Moss et al. | 361/225 |
| 4,371,252 | 2/1983 | Uchita et al. | 355/219 |
| 4,380,384 | 4/1983 | Uneo et al. | 355/219 |
| 4,382,673 | 5/1983 | Nakajima et al. | 355/274 |
| 4,449,013 | 5/1984 | Garschick | 174/106 SC X |

FOREIGN PATENT DOCUMENTS

| | | | |
|---|---|---|---|
| 0035745 | 9/1981 | European Pat. Off. . | |
| 3101678 | 12/1981 | Fed. Rep. of Germany . | |
| 58-14858 | 1/1983 | Japan . | |
| 61-148468 | 7/1986 | Japan | 355/219 |

*Primary Examiner*—Joan H. Pendegrass

*Attorney, Agent, or Firm*—Fitzpatrick, Cella, Harper & Scinto

[57] ABSTRACT

There is provided a charging member comprising an electroconductive substrate, and an elastic layer, an electroconductive layer and a resistance layer disposed in this order on the substrate. Such charging member provides good contact with a photosensitive member, to provide good image quality without causing an image defect such as white spot based on charging unevenness. Further, the charging member causes no leak even when the photosensitive member has a pin hole, and reduced the level of noise based on an AC voltage to be applied thereto.

36 Claims, 3 Drawing Sheets

CHARGING MEMBER

FIELD OF THE INVENTION AND RELATED ART

The present invention relates to a charging member, particularly to a charging member for charging a charge-receiving member disposed in contact therewith.

In conventional electrophotographic processes, there have been used photosensitive members utilizing a photosensitive layer comprising selenium, cadmium sulfide, zinc oxide, amorphous silicon, organic photoconductor, etc. There photosensitive members are subjected to a fundamental electrophotographic process including charging, exposure, developing, transfer, fixing and cleaning steps, whereby a copied image is provided.

In the above-mentioned conventional charging step, in most cases, a high voltage (DC voltage of about 5–8 KV) is applied to a metal wire to generate a corona, which is used for the charging. In this method, however, a large amount of corona discharge product such as ozone and NOx is generated along with the corona charging. Such corona discharge product deteriorates the photosensitive member surface to cause image quality deterioration such as image blur (or image fading). Further, because the contamination on the metal wire affects the image quality, there has been caused a problem that white droppings (or white dropout) or black streaks occur in the resultant copied image. Moreover, the proportion of the current directed to the photosensitive member is generally 5–30% of the consumed current, and most thereof flows to a shield plate disposed around the metal wire. As a result, the conventional corona charging method has been low in electric power efficiency.

Therefore, in addition to the above-mentioned corona charging method, there has been researched a contact charging method wherein a charging member is caused to directly contact a photosensitive member to charge the photosensitive member without using the corona discharger, as disclosed in Japanese Laid-Open Patent Application (JP-A, KOKAI) Nos. 178267/1982, 104351/1981, 40566/1983, 139156/1983, 150975/1983, etc. More specifically, in this method, a charging member such as an electroconductive elastic roller to which a DC voltage of about 1–2 KV is externally applied is caused to contact the surface of a photosensitive member and charges are directly injected to the photosensitive member surface thereby to charge the photosensitive member surface up to a predetermined potential.

In the conventional charging member such as the above-mentioned conductive elastic roller, an electroconductive rubber portion containing conductive particles such as carbon dispersed therein is fixed to a metal core, and as the amount of the carbon dispersed in the conductive rubber portion is increased and the density thereof becomes larger, the rubber hardness is changed due to the irregularity or variation in the dispersion degree of the carbon, and partial irregularity in hardness is liable to occur at the roller surface, whereby such hardness irregularity prevent the roller from closely contacting the photosensitive member surface.

In the conventional electrode roller wherein a single layer of an electroconductive rubber is disposed on a metal core, even when the rubber hardness of the electrode roller is decreased to 40 degrees or below and the nip width between the roller and a photosensitive member is increased in order to improve the contact with the photosensitive member surface, it is necessary that the dispersion amount of the carbon is decreased and the density thereof is also decreased so as to decrease the rubber hardness. As a result, there is liable to occur irregularity in the electroconductivity or roller hardness at the roller surface. Such irregularity at the surface prevents uniform charging to the photosensitive member and causes irregularity in charging.

It has been proposed that an electrode roller is caused to have a two-layer structure comprising an elastic rubber layer and a semiconductive rubber layer to regulate the roller hardness by utilizing the elastic rubber layer and to increase the nip width (Japanese Laid-Open Application for Utility Model Registration No. 199349/1982). Even in such case, however, it is difficult for the uneven electrode roller surface contacting the photosensitive member surface under pressure to provide close contact therebetween, whereby charging unevenness (unevenness or irregularity in charging) is liable to occur.

Thus, when charging treatment is conducted by a contact charging method by using the above-mentioned charging member, a photosensitive member surface is not evenly charged to cause charging unevenness in the form of spots. Accordingly, e.g., in a reversal development system, when the photosensitive member having the charging unevenness in the form of spots is subjected to an electrophotographic process including an image exposure step, the output image includes black spot-like images (black spots) corresponding to the abovementioned spot-like charging unevenness. On the other hand, a normal development system provide an output image including white spot-like image (white spots), whereby it has been difficult to obtain a high-quality image.

In order to solve the above-mentioned problems and to obviate the charging unevenness, there has been proposed that an AC voltage is superposed on a DC voltage to be supplied to a charging member.

When only a DC voltage is applied to the charging member, the charging characteristic is greatly affected by the surface characteristic of the charging member. However, when an AC voltage ($V_{AC}$) is superposed on the DC voltage ($V_{DC}$), the resultant pulsation voltage ($V_{DC}+V_{AC}$) is applied to the charging member, whereby uniform charging is effected without the influence of the surface characteristic of the charging member.

In such case, in order to retain the uniformity in charging and to prevent an image defect such as the white spot in the normal development system, and fog or the black spot in the reversal development system, it is necessary that the AC voltage to be superposed has a certain peak-to-peak potential difference ($V_{p-p}$). However, when the AC voltage to be superposed in increased in order to prevent image defects, discharge dielectric breakdown is liable to occur in a portion of the interior of the photosensitive member wherein a slight defect has occurred at the time of coating, due to the maximum (or peak) application voltage of the pulsation voltage. Further, when the photosensitive member has a pin hole, such portion becomes a continuity path and causes leakage of a current, whereby the voltage applied to the charging member drops.

In the case of normal development system, such voltage drop appears as a white defect extending along the longitudinal direction of the contact portion between the electroconductive member and the photosensitive member. On the other hand, in the case of reversal development system, such voltage drop appears as a black streak extending along the longitudinal direction of the contact portion.

Further, when the charging member has a certain hardness, the charging member vibrates because of the frequency of the AC voltage for suerposition to be applied thereto, and such vibration is transmitted to the photosensitive member closely contacting the charging member, whereby the photosensitive member produces unpleasant noise.

SUMMARY OF THE INVENTION

An object of the present invention is to provide a charging member which has an ability to uniformly charge another member without causing charging unevenness and provides an image of good quality free of image defects.

Another object of the present invention is to provide a charging member which does not cause dielectric breakdown in a defective portion of a photosensitive member, and prevents voltage drop due to current leakage even in a pin hole, if any.

A further object of the present invention is to provide a charging member which prevents unpleasant noise due to vibration caused by an AC voltage to be applied thereto.

According to the present invention, there is provided a charging member, comprising: an electroconductive substrate, and an elastic layer, an electroconductive layer and a resistance layer disposed in this order on the substrate.

The present invention also provides a contact charging method, comprising: providing the abovementioned charging member; providing a charge-receiving member disposed in contact with the charging member; and applying a voltage to the charging member by means of an external power supply, thereby to charge the charge-receiving member.

The present invention further provides an electrophotographic apparatus, comprising: the abovementioned charging member; and an electrophotographic photosensitive member disposed in contact with the charging member.

These and other objects, features and advantages of the present invention will become more apparent upon a consideration of the following description of the preferred embodiments of the present invention taken in conjunction with the accompanying drawings.

DETAILED DESCRIPTION OF THE INVENTION

Hereinbelow, for convenience, there is described an embodiment wherein the charging member according to the present invention is used for charging a photosensitive member in an electrophotographic apparatus, while the charging member of the present invention can be used for discharging the photosensitive member before a primary charging step.

Figure 1B:
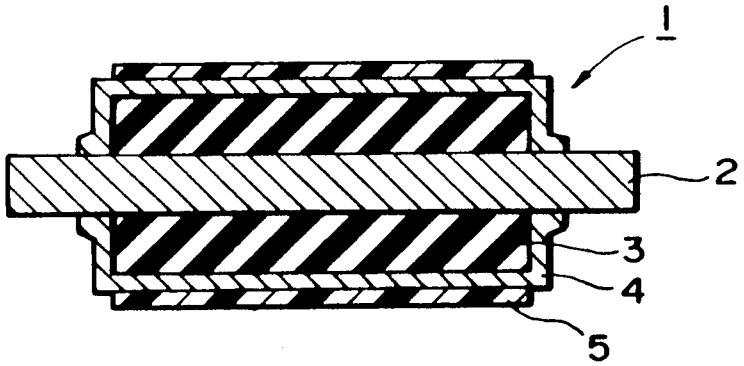
FIGS. 1A and 1B are schematic sectional views showing cross sections of an embodiment of the charging member according to the present invention in lateral and longitudinal directions, respectively.
Figure 1A:
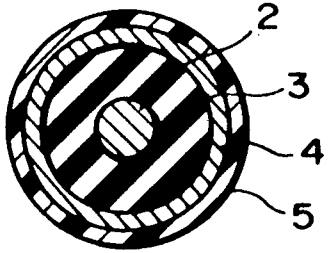

Referring to FIG. 1, the charging member 1 according to the present invention has a function separation-type structure and basically comprises an electroconductive substrate 2; and an elastic or elastomeric layer 3, an electroconductive layer 4 and a resistance layer 5, which are disposed on the conductive substrate 2 in this order.

Figure 2:
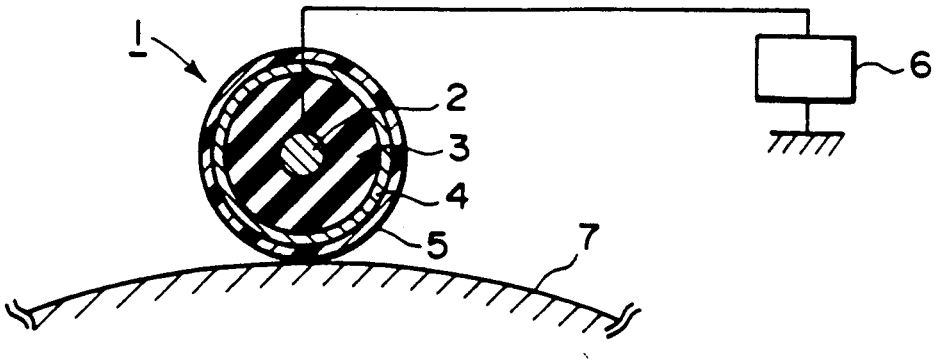
FIG. 2 is a schematic sectional view showing an embodiment wherein a photosensitive member is charged by means of the charging member according to the present invention.

Further, referring to FIG. 2, when a photosensitive member 7 is charged by using the charging member 1, a voltage is applied to the charging member 1 by means of an external power supply 6 connected thereto and the photosensitive member 7 disposed in contact with the charging member 1 is charged.

In the present invention, because the charging member 1 has the above-mentioned structure, the close contact area thereof with a photosensitive member and the nip width between the charging member and the photosensitive member are enlarged and the charging member is caused to uniformly contact the photosensitive member, whereby the photosensitive member is uniformly charged without charging unevenness. As a result, image defects such as white spots in the case of a normal development system and black spots in the case of a reversal development system are obviated, whereby an image of good quality is obtained.

More specifically, in the present invention, because the resistance layer 5 may comprise a thin layer of a resin such as polyamide such as nylon, cellulose, polyester and polyethylene, the surface of the resistance layer 5 becomes uniform and smooth, and unevenness in the thickness thereof is reduced. Further, because the elastic layer 3 and the conductive layer 4 are separately provided in the interior of the charging member 1, the softness and conductivity may separately be controlled respectively. As a result, there has been solved a problem in an electroconductive rubber which has been difficult to be softened in the prior art.

The charging member according to the present invention having the above-mentioned structure retains sufficient conductivity on the basis of the conductive layer 4, and provides uniform close contact with a photosensitive member on the basis of the softness of the elastic layer 3 and the surface smoothness of the resistance layer 5, whereby it effects uniform charging without charging unevenness.

Further, in the present invention, the conductive layer 4 and resistance layer 5 separately disposed prevent dielectric breakdown due to an internal defect of a photosensitive member and, even when the photosensitive member has a pin hole, they prevent an image defect such as a white defect extending along the longitudinal direction of the contact portion between the charging member and the photosensitive member in the case of normal development system, and a black streak in the case of reversal development system, thereby to provide an excellent image.

Generally speaking, when a photosensitive member is produced by using a coating method, a defect in the resultant coating film such as dust and collision mark is unavoidable. When the conductive layer of a charging member directly contacts such photosensitive member, charges are partially concentrated on such defect to cause dielectric breakdown, because of the low resistivity of the defective portion. When the photosensitive member has a pin hole thereon, a continuity path is formed in the interior of the photosensitive member contacting the conductive layer, whereby a leak occurs and charges escape. As a result, a load is applied to an external power supply unit for voltage application, and there occurs a phenomenon that the voltage to be applied to the photosensitive member considerably falls.

When such phenomenon occurs, a portion of the photosensitive member surface contacting the charging member is not provided with sufficient charges. Therefore, in the case of normal development system, such phenomenon appears as a white defect or dropping extending along the longitudinal direction of the contact portion between the charging member and the photosensitive member. On the other hand, in the case of reversal development system, such phenomenon appears as a black streak extending along the longitudinal direction of the contact portion.

On the contrary, when the charging member of the present invention having the above-mentioned structure is used, the portion thereof contacting a photosensitive member comprises the resistance layer 5, whereby charges are dispersed and dielectric breakdown in a defective portion is prevented. Even when continuity occurs in the pin hole portion of the photosensitive member, the resistance to the applied voltage is retained by the presence of the resistance layer 5, whereby a load is not applied to the external power supply unit and the voltage drop is prevented. As a result, an image defect such as white dropping or black streak based on the pin hole may be prevented.

Further, the charging member according to the present invention may prevent or reduce the noise due to an AC voltage to be applied thereto from the external power supply.

More specifically, because the conventional charging member has a problem in softness because of the maintenance of conductivity, it causes vibration due to the AC waves. Such vibration is as such transmitted to a photosensitive member disposed in contact with the charging member whereby the photosensitive member and the interior thereof produce unpleasant noise.

On the contrary, the charging member of the present invention absorbs the vibration due to a pulsation voltage applied thereto, on the basis of the softness of the elastic layer 3 disposed between the conductive substrate 2 and the conductive layer 4. Therefore, the vibration is not transmitted to the photosensitive member contacting the charging member, whereby the unpleasant noise produced by the photosensitive member or the interior thereof is prevented or reduced.

Hereinbelow, there is specifically described the structure of the charging member according to the present invention.

The electroconductive substrate 2 may comprise a metal such as iron, copper and stainless steel; an electroconductive resin such as a resin containing carbon particles dispersed therein and a resin containing metal particles dispersed therein; etc. The form of the substrate 2 may be a bar, a plate, etc.

The elastic layer 3 is a layer having a good elasticity and a low hardness. In view of the contact characteristic with a photosensitive member based on its softness and the vibration-absorbing characteristic, the elastic layer 3 may preferably have a rubber hardness of 35 degrees or smaller, more preferably 30 degrees or smaller, particularly preferably in the range of 12 to 25 degrees, in terms of a rubber hardness measured by means of a JIS-A type tester (Teclock GS-706, mfd. by Teclock Co.) according to JIS K-6301.

The thickness of the elastic layer 3 may preferably be 1.5 mm or larger, more preferably 2 mm or larger, particularly preferably in the range of 3 mm to 13 mm, in consideration of the above-mentioned viewpoints.

Specific example of the material constituting the elastic layer 3 may include: rubbers or sponges such as chloroprene rubber, isoprene rubber, EPDM (ethylene-propylene-diene methylene linkage) rubber, polyurethane rubber, epoxy rubber, and butyl rubber; thermoplastic elastomers such as styrene-butadiene thermoplastic elastomer, polyurethane-type thermoplastic elastomer, polyester-type thermoplastic elastomer, and ethylene-vinyl acetate type thermoplastic elastomer; etc. Further, in order to control the hardness of the elastic layer 3, electroconductive particle may be added thereto, as desired.

The conductive layer 4 is a layer having a high electroconductivity, and may preferably be one having a volume resistivity of $10^7$ ohm.cm or below, more preferably $10^6$ ohm.cm or below, particularly preferably in the range of $10^{-2}$ to $10^6$ ohm.cm. The conductive layer 4 may be a thin layer, in order to transmit the softness of the elastic layer 3 disposed thereunder to the resistance layer 5 disposed thereon. More specifically the thickness of the conductive layer 4 may preferably be 3 mm or smaller, more preferably 2 mm or smaller, particularly preferably in the range of 20 microns to 1 mm.

The material constituting the conductive layer 4 may be a metal vapor deposition layer, a resin containing electroconductive particle dispersed therein, an electroconductive resin, etc. Specific examples of the metal vapor deposition layer may include a vapor deposition layer of a metal such as aluminum, indium, nickel, copper and iron. Specific examples of the resin containing electroconductive particles dispersed therein may include: one obtained by dispersing conductive particles such as carbon, aluminum, nickel, and titanium oxide, in a resin such as polyurethane, polyester, vinyl acetate-vinyl chloride copolymer, and polymethyl methacrylate. Specific examples of the conductive resin may include polymethyl methacrylate containing a quaternary ammonium salt, polyvinyl aniline, polyvinyl pyrrole, poly-diacetylene, and polyethylene imine.

Among these, the resin containing electroconductive particles dispersed therein is particularly preferred in order to easily control the conductivity.

The resistance layer 5 may preferably be so constituted that it has a higher resistivity them that of the conductive layer 4 disposed thereunder. The volume resistivity of the resistance layer 5 may preferably be higher than that of the conductive layer 4 by a factor of one to six figures, more preferably by a factor of two to five figures. In other words, the volume resistivity of the resistance layer 5 may preferably be $10^1$ to $10^6$ times, more preferably $10^2$ to $10^5$ times that of the electroconductive layer 4. The volume resistivity of the resistance layer 5 may preferably be in the range of $10^6$ to $10^{12}$ ohm.cm, more preferably in the range of $10^7$ to $10^{11}$ ohm.cm. The resistance layer 5 may preferably have a thickness of 1 to 500 microns, more preferably 50 to 200 microns, in view of the charging characteristic.

The material constituting the resistance layer 5 may be a resin such as a semi-conductive resin, and an insulating resin containing electroconductive particles dispersed therein. More specifically, the semi-conductive resin may include resins such as ethyl cellulose, nitrocellulose, methoxy-methylated nylon, ethoxymethylated nylon, copolymer nylon, polyvinyl pyrrolidone, and casein; a mixture of two or more species of these resins; or a dispersion obtained by dispersing a small amount of conductive particles in such resin, etc. The insulating resin containing conductive particles dispersed therein may include one obtained by dispersing a small amount of conductive particles such as carbon, aluminum indium oxide, and titanium oxide, in an insulating resin such as polyurethane, polyester, vinyl acetate-vinylchloride copolymer, and polymethacrylic acid ester, to regulate the resistivity thereof. Among these, the semiconductive resin essentially consisting of a resinous material (i.e., containing substantially no electroconductive particles) is preferred in view of uniformity and smoothness of the surface of the resistance layer.

Figure 3:
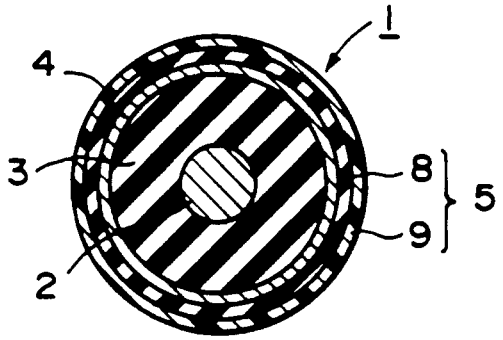
FIG. 3 is a schematic lateral sectional view showing an embodiment of the charging member according to the present invention which has a resistance layer of a two-layer structure.

The resistance layer 5 may have a two-layer structure, as desired. For example, when the material constituting the resistance layer 5 comprises a rubber or resin to which a plasticizer as an additive has been added in order to enhance the softness thereof, the added plasticizer sometimes migrate to or exudes from the surface of the resistance layer 5, when the charging member is successively used or used under a certain condition. In such case, a photosensitive member disposed in contact with the charging member is affected by the exuded plasticizer, a photoconductive material contained in the photosensitive member can deteriorate, or the photosensitive member can adhere to the charging member and the surface of the photosensitive member is peeled therefrom. In order to easily prevent such ill effect, the resistance layer 5 of the charging member 1 may be separated into two layers of an internal resistance layer 8 and a surface resistance layer 9, as shown in FIG. 3.

In such embodiment, a softness-imparting agent such as plasticizer may be added to the internal resistance layer 8, and the surface resistance layer 9 may be disposed thereon, whereby the exudation of the plasticizer, etc., to the surface is prevented and a charging member supplied with more softness is obtained. Such charging member further improves the contact characteristic thereof with the photosensitive member and charging characteristic, and more effectively prevents the above-mentioned noise.

When the resistance layer has a two-layer structure, the internal layer 8 is so constituted that it has a higher resistivity than that of the conductive layer 4 disposed thereunder. The volume resistivity of the internal resistance layer 8 may preferably be higher than that of the conductive layer 4 by a factor of one to six figures, more preferably, by a factor of two to five figures. The volume resistivity of the internal resistance layer 8 may preferably be in the range of $10^6$ to $10^{12}$ ohm.cm, more preferably in the range of $10^7$ to $10^{11}$ ohm.cm. The internal resistance layer 8 may preferably have a thickness of 1 to 450 microns, more preferably 50 to 200 microns.

The material constituting the internal resistance layer 8 may be, in addition to the above-mentioned semi-conductive resin and insulating resin containing electroconductive particles dispersed therein, rubbers such as epichlorohydrin rubber, epichlorohydrin-ethylene oxide rubber, polyurethane rubber, epoxy rubber, butyl rubber, chloroprene rubber, and styrene-butadiene rubber; mixtures of two or more species of these rubbers; semi-conductive rubber obtained by dispersing conductive particles in such rubber; etc. Among these, the semi-conductive rubber such as epichlorohydrin rubber and epichlorohydrinethylene oxide rubber is preferred. Examples of the plasticizer may include: phthalic acid-type compounds such as dibutyl phthalate, phospholic acid-type compounds such as tricresyl phosphate, epoxy-type compounds such as alkyl epoxystearate, etc.

When the internal resistance layer comprises a resin, the resin may preferably have a tensile elasticity modulus of 200 $Kgf/mm^2$ or below, more preferably in the range of 50 to 150 $kgf/mm^2$, in view of the softness. When the internal resistance layer comprises a rubber, the rubber has a rubber hardness of 35 degrees or below, more preferably in the range of 10 to 30 degrees, in terms of the above-mentioned rubber hardness.

The surface resistance layer 9 may preferably be so constituted that it has a higher resistivity than that of the conductive layer 4, similarly as in the case of the internal resistance layer 8. The volume resistivity of the surface resistance layer 9 may preferably be higher than that of the conductive layer 4 by a factor of one to six figures, more preferably, by a factor of two to five figures. The resistivity of the surface resistance layer 9 can be lower than, higher than or equal to that of the internal resistance layer 8. In view of uniform charging, the volume resistivity of the internal resistance layer may preferably be 1 to 50 times, more preferably 2 to 10 times that of the surface resistance layer. The volume resistivity of the surface resistance layer 9 may preferably be in the range of $10^6$ to $10^{12}$ ohm.cm, more preferably in the range of $10^7$ to $10^{11}$ ohm.cm. The surface resistance layer 9 may preferably have a thickness smaller than that of the internal resistance layer 8 in order not to impair the softness of the internal resistance layer 8 disposed thereunder. The thickness of the surface resistance layer 9 may preferably be 0.1-50 microns, more preferably 1-30 microns.

The material constituting the surface resistance layer 9 may be a resin such as the above-mentioned semi-conductive resin, and an insulating resin containing electroconductive particles dispersed therein.

In the charging member according to the present invention, in addition to the above-mentioned layers, there can be disposed another layer such as adhesive layer in order to enhance the adhesion property between the respective layers.

The charging member 1 according to the present invention may for example be prepared in the following manner.

First, there is provided a metal bar as an electroconductive substrate 2 of a charging member 1. An elastic layer 3 is formed on the substrate 2 by using the material therefor by melt molding, injection molding, dip coating or spray coating, etc. Then, an electroconductive layer 4 is formed on the elastic layer 3 by using the material therefor by melt molding, injection molding, dip coating or spray coating, etc. Further, a resistance layer 5 is formed on the electroconductive layer 4 by using the material therefor by dip coating, spray coating or gravure coating, etc.

The shape of the charging member 1 may be any of a roller, a blade, a belt, etc., and may appropriately be selected corresponding to the specification or form of an electrographic apparatus.

Figure 4:
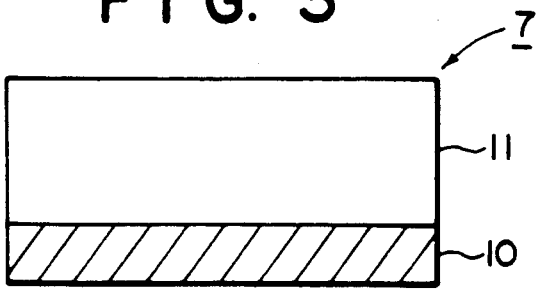
FIGS. 4 and 5 are schematic sectional views each showing a laminate structure of an embodiment of the charging member according to the present invention.

The member to be charged by means of the charging member according to the present invention may be any of a dielectric, an electrophotographic photosensitive member, etc. Such electrophotographic photosensitive member 7 may for example be constituted as shown in FIG. 4.

The photosensitive member 7 for electrophotography comprises an electroconductive substrate 10 and a photosensitive layer 11 disposed thereon. The electroconductive substrate 10 may be a substrate which per se has an electroconductivity such as that of aluminum, aluminum alloy, and stainless steel; alternatively, the above-mentioned electroconductive substrate or a substrate of a plastic coated with, e.g., a vapor-deposited layer of aluminum, aluminum alloy, or indium oxide-tin oxide alloy; a plastic or paper substrate impregnated with a mixture of an electroconductive powder such as tin oxide or carbon black and an appropriate binder; or a substrate comprising an electroconductive binder.

Between the electroconductive substrate 10 and the photosensitive layer 11, there may be formed a primer or undercoat layer having a barrier function and an adhesive function. The primer layer may be formed of, e.g., casein, polyvinyl alcohol, nitrocellulose, ethylene-acrylic acid copolymer, polyamide, polyurethane, gelatin, or aluminum oxide. The thickness of the primer layer should preferably be 5 microns or below, particularly 0.5 to 3 microns. The primer layer may preferably have a volume resistivity of $10^7$ ohm.cm or above, in order to fully perform its function.

The photosensitive layer 11 may for example be formed by using a photoconductive material such as organic photoconductor, amorphous silicon and selenium, together with a binder as desired, by a coating method or vacuum vapor deposition. When the organic photoconductor is used, the photosensitive layer 11 may preferably have a laminate structure comprising a charge generation layer 12 capable of generating charge carriers and a charge transport layer 13 capable of transporting the thus generated charge carriers.

The charge generation layer 12 comprises at least one species of charge-generating substance such as azo pigments, quinone pigments, quinocyanine pigments, perylene pigments, in digo pigments, bis-benzimidazole pigments, phthalocyanine pigments, and quinacrydone pigments. The charge generation layer may be formed by vapor-depositing such charge-generating substance, or by applying a coating liquid containing such charge-generating substance dispersed therein, together with an appropriate binder as desired, while the binder is omissible.

The binder for forming the charge generation layer may be selected from a wide variety of insulating resins or alternatively from organic photoconductive polymers such as polyvinylcarbazole, polyvinylanthracene, and polyvinylpyrene. Specific examples of the insulating resin include polyvinyl butyral, polyvinylbenzol, polyarylates (e.g., polycondensation product between bisphenol A and phthalic acid), polycarbonate, polyester, phenoxy resin, acrylic resin, polyacrylamide resin, polyamide, cellulose resin, urethane resin, epoxy resin, casein, and polyvinyl alcohol.

The charge generation layer may generally have a thickness of 0.01–15 microns, preferably 0.05–5 microns. In the charge generation layer, the weight ratio of the charge-generating substance to the binder may preferably be 10:1–1:20.

The solvent used in the above-mentioned coating liquid or paint may be selected in view of the solubility or dispersion stability of the resin or the charge-generating substance. Examples of such solvent may include organic solvents such as alcohols, sulfoxides, ethers, esters, aliphatic halogenated hydrocarbons, or aromatic compounds, etc.

Formation of a charge transportation layer 12 by way of application may be practiced according to a coating method such as dip coating, spray coating, spinner coating, wire bar coating, blade coating, etc.

The charge transport layer 13 may comprise a resin having a film-formability and a charge-transporting substance dissolved or dispersed therein. The charge-transporting substance used in the present invention may include: organic materials such as hydrazone compounds, stilbene-type compounds, thiazole compounds, and triarylmethane compounds. One or more species of these charge-transporting substances are appropriately selected and used.

Examples of the binder to be used in the charge transportation layer may include: phenoxy resins, polyacrylamide, polyvinyl butyral, polyallylate, polysulfone, polyamide, acrylic resins, acrylonitrile resins, methacrylic resins, vinyl chloride resins, vinyl acetate resins, phenol resins, epoxy resins, polyester resins, alkyd resins, polycarbonate, polyurethane or a copolymer resins containing two or more of the recurring units of these resins, such as styrene-butadiene copolymers, styrene-acrylonitrile copolymers, styrene-maleic acid copolymers, etc. Also, other than such insulating polymers, organic photoconductive polymers such as poly-N-vinylcarbazole, polyvinylanthracene or polyvinylpyrene may be used.

The charge transportation layer 13 may generally have a thickness of 5–50 microns, preferably 8–20 microns. The weight ratio of the charge-transporting substance to the binder may generally be about 5:1 to 1:5, preferably about 3:1 to 1:3. The charge transport layer 13 may be formed by using the above-mentioned coating method.

Further, because the above-mentioned coloring matter, pigment, organic charge-transporting substance, etc., may generally be affected by contamination due to oil, etc., or ultraviolet rays, ozone, etc., a protective layer may be provided in the photosensitive member, as desired. The protective layer may preferably have a surface resistivity of $10^{11}$ ohm. or larger in order to form an electrostatic image thereon.

The protective layer, usable in the present invention, can be formed by applying a solution of a resin such a polyvinylbutyral, polyester, polycarbonate, acrylic resin, methacrylic resin, nylon, polyimide, polyarylate, polyurethane, styrene-butadiene copolymer, styrene-acrylic acid copolymer, styrene-acrylonitrile copolymer, etc., dissolved in an appropriate organic solvent on the photosensitive layer, followed by drying. In this case, the film thickness of the protective layer is generally 0.05 to 20 microns, preferably 1–5 microns.

In the protective layer, UV-ray absorbers, etc., can also be contained.

Figure 6:
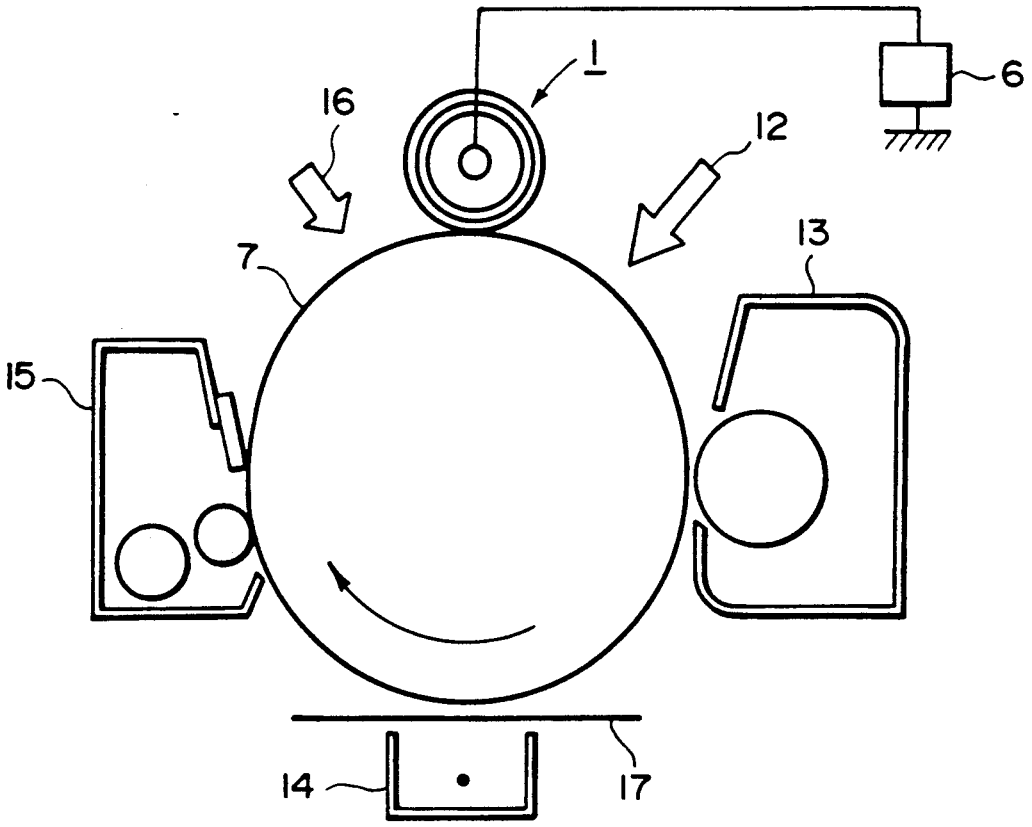
FIG. 6 is a schematic sectional view showing an electrophotographic apparatus using the charging member according to the present invention.

The charging member 1 according to the present invention may be applied to an electrophotographic apparatus as shown in FIG. 6.

Referring to FIG. 6, the electrophotographic apparatus comprises: a cylindrical photosensitive member 7, and around the peripheral surface of the photosensitive member 7, a primary charging roller 1 as a charging member, an image exposure means (not shown) for providing a light beam 12 to form a latent image on the photosensitive member 7, a developing means 13 for developing the latent image with a toner (not shown) to form a toner image, a transfer charging means 14 for transferring the toner image from the photosensitive member 7 onto a transfer-receiving material 17, a cleaner 15 for removing a residual toner, and a preexposure means for providing light 16.

In operation, a prescribed voltage is externally applied to the photosensitive member 7 by means of the primary charging roller 1 disposed in contact therewith, thereby to charge the surface of the photosensitive member 7, and the photosensitive member 7 is imagewise exposed to light 12 corresponding to an original image by the image exposure means, thereby to form an electrostatic latent image on the photosensitive member 7. Then, the electrostatic latent image formed on the photosensitive member 7 is developed or visualized by attaching the toner or developer contained in the developing means 13 to form a toner image on the photosensitive member. The toner image is then transferred to the transfer-receiving material 17 such as paper by means of the transfer charger 14 to form a toner image thereon which may be fixed to the transfer-receiving material 17, as desired. The residual toner which remains on the photosensitive member 7 without transferring to the transfer-receiving material 17 at the time of transfer is recovered by means of the cleaner 15.

Thus, the copied image is formed by such electrophotographic process. In a case where residual charges remain on the photosensitive member 7, the photosensitive member 7 may preferably be exposed to light 16 by the pre-exposure means to remove the residual charge, prior to the above-mentioned primary charging.

The light source for providing light 12 for image exposure may be a halogen lamp, a fluorescent lamp, a laser, an LED, etc. The developing means 13 may be an apparatus used for a two-component developing method, or a one-component developing method using a magnetic or non-magnetic toner. Further, the development system may be either normal development system or reversal development system.

The arrangement of the charging member 1 disposed in contact with the photosensitive member 7 should not particularly be restricted. More specifically, such arrangement may include: one wherein the charging member 1 is fixed; or one wherein the charging member 1 is moved or rotated in the same direction as or in the counter direction to that of the movement of the photosensitive member 7. Further, the charging member 1 can also be caused to have a cleaning function of removing the residual toner particles attached to the photosensitive member 7.

In the direct charging method according to the present invention, the voltage applied to the charging member 1 may preferably be one in the form of a pulsation (or pulsating current) voltage obtained by superposing an AC voltage on a DC voltage. In such case, there may preferably be used a pulsation voltage obtained by superposing a DC voltage of ±200 V to ±1500 V on an AC voltage having a peak-to-peak voltage of 2000 V or below.

The application method for such voltage, while also varying depending on tee specifications of respective electrophotographic apparatus, may include: one wherein a desired voltage is instantaneously applied; one wherein the applied voltage is gradually or stepwise raised in order to protect a photosensitive member; or one wherein a DC voltage and an AC voltage are applied in a sequence of from DC voltage to AC voltage, or of from AC voltage to DC voltage. Further, a low DC voltage can be applied to the charging member according to the present invention.

In the present invention, the process for image exposure, developing, cleaning, etc., may be any of processes known in the field of electrophotography, and the kind of the developer or toner should not particularly be limited.

An electrophotographic apparatus using the charging member according to the present invention may be used not only for ordinary copying machines but also in the fields related to electrophotography such as laser printers, CRT printers and electrophotographic plate-making.

The charging member according to the present invention may remarkably exhibit its characteristic when used in combination with an electrophotographic photosensitive member which contains a photosensitive layer comprising an organic photoconductor which and can easily be deteriorated with respect to the mechanical strength and chemical stability.

The present invention will be explained more specifically with reference to examples.

EXAMPLE 1

A charging member was prepared in the following manner.

Referring to FIG. 1, around an iron core 2 having a diameter of 5 mm and a length of 250 mm, a 12.5 mm-thick elastic layer 3 was formed by melt molding by use of a chloroprene rubber so that the resultant elastic layer had a diameter of 30 mm, a length of 230 mm, and a rubber hardness of 15 degrees as measured by means of a JIS-A type rubber hardness tester (Teclock GS-706, mfd. by Teclock Co.).

Then, a polyurethane paint containing electroconductive carbon particles dispersed therein (trade name: Sintron, mfd. by Shinto Toryo K.K.) was applied onto the elastic layer 3 by dip coating and then dried, thereby to form a 20 micron-thick electroconductive layer 4 on the elastic layer 3.

Further, a coating liquid obtained by dissolving 10 parts of methoxymethylated nylon-6 (methoxymethylation degree: 30%) in 90 parts of methanol was applied onto the electroconductive layer 4 by dip coating and dried to form thereon a 100 micron-thick resistance layer 5, whereby a charging roller 1 for primary charging No. 1 was prepared as a charging member.

Incidentally, an electroconductive layer 4 and a resistance layer 5 were separately formed on an Al sheet by dip coating, respectively, and the volume resistivity of each layer was measured.

Separately, an electrophotographic photosensitive member was prepared in the following manner.

Figure 5:
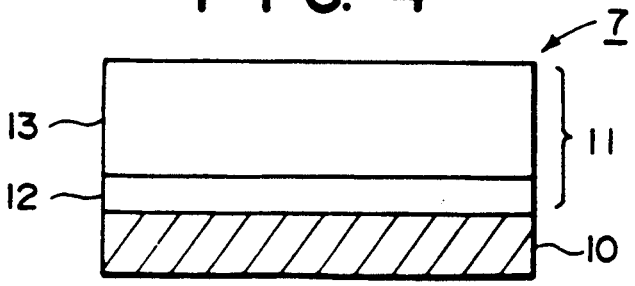

First, referring to FIG. 5, there was provided an electroconductive substrate 10 of an aluminum cylinder having a wall thickness of 0.5 mm, a diameter of 60 mm and a length of 260 mm. A coating liquid obtained by dissolving 4 parts of a copolymer nylon (trade name: Amilan CM-8000, mfd. by Toray K.K.) and 4 parts of a nylon-8 (trade name: Luckamide 5003, mfd. by Dainihon Ink K.K.) in 50 parts of methanol and 50 parts of n-butanol was applied onto the electroconductive substrate 10 to form a 0.6 micron-thick polyamide undercoat layer.

Next, 10 parts of a disazo pigment represented by the following structural formula as a charge-generating substance, and 10 parts of a polyvinyl butyral resin (S-LEC BM2, mfd. by Sekisui Kagaku K.K.) as a binder resin were dispersed in 120 parts of cyclohexanone by means of a sand mill for 10 hours.

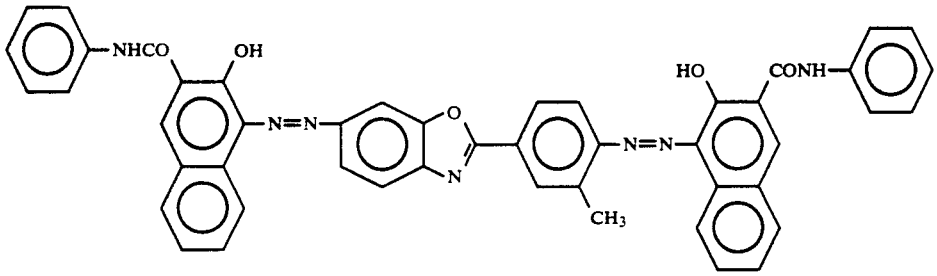

To the resultant dispersion, 30 parts of methyl ethyl ketone was added, and then the dispersion was applied onto the undercoat layer by dip coating to form a 0.15 micron-thick charge generation layer 12.

Then, 10 parts of a hydrazone compound represented by the following structural formula as a charge-transporting substance, and 10 parts of a polycarbonate-Z resin (weight-average molecular weight of 20,000, mfd. by Mitsubishi Gas Kagaku K.K.) as a binder resin were dissolved in 80 parts of monochlorobenzene.

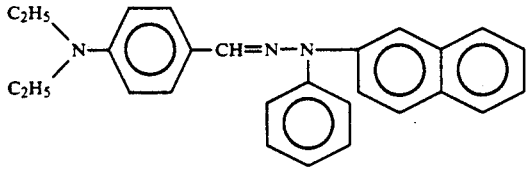

The resultant coating liquid was applied onto the above-mentioned charge generation layer 12 to form a 16 micron-thick charge transport layer 13, whereby a photosensitive member (No. 1) was prepared.

The thus prepared photosensitive member No. 1 was assembled in an electrophotographic copying machine using a normal development system (trade name: PC-10, mfd. by Canon K.K.) which had been so modified that the above-mentioned primary charging roller No. 1 was assembled instead of the primary corona charger as shown in FIG. 6.

In such apparatus, a superposition of a DC voltage of −750 V and an AC voltage having a peak-to-peak voltage of 1300 V was applied to the primary charging roller 1, whereby there were measured a dark part potential, a light part potential, an image defect, and noise. In addition, there was measured a leak in a case where a pin hole having a diameter of 1 mm was made in the photosensitive member.

More specifically, the above-mentioned items were measured in the following manner.

Dark part potential and light part potential

After 1 sec. counted from the primary charging, these potentials were measured by means of Treck electrometer (mfd. by Treck Co., United Kingdom). In the case of the light part potential, the photosensitive member was exposed to light of 5 lux.sec. after 0.3 sec. counted from the primary charging.

Image defect and leak

Copied images were observed with the eyes.

Noise

In an anechoic chamber, the sound level was measured by means of a sound-level meter which was disposed with a horizontal distance of 1 m from the copy machine.

The results are shown in Table 1 appearing hereinafter.

EXAMPLE 2

A primary charging roller No. 2 was prepared in the same manner as in the preparation of the primary charging roller No. 1 in Example 1, except that an iron core having a diameter of 28 mm was used and an elastic layer 3 having a thickness of 3 mm was formed.

The thus prepared primary charging roller No. 2 was evaluated in the same manner as in Example 1. The results are shown in Table 1 appearing hereinafter.

EXAMPLE 3

A primary charging roller No. 3 was prepared in the same manner as in the preparation of the primary charging roller No. 1 in Example 1, except that an elastic layer 3 having a hardness of 35 degrees was formed.

The thus prepared primary charging roller No. 3 was evaluated in the same manner as in Example 1. The results are shown in Table 1 appearing hereinafter.

EXAMPLE 4

A primary charging roller No. 4 was prepared in the same manner as in the preparation of the primary charging roller No. 1 in Example 1, except that an elastic layer 3 having a thickness of 10 mm and a hardness of 25 degrees was formed by using a silicone rubber by injection molding, an electroconductive layer 4 having a thickness of 1 mm was formed and a resistance layer was formed by using ethoxymethylated nylon-6.

The thus prepared primary charging roller No. 4 was evaluated in the same manner as in Example 1. The results are shown in Table 1 appearing hereinafter.

EXAMPLE 5

A primary charging roller No. 5 was prepared in the same manner as in the preparation of the primary charging roller No. 4 in Example 4, except that an electroconductive layer 4 having a thickness of 3 mm was formed.

The thus prepared primary charging roller No. 5 was evaluated in the same manner as in Example 1. The results are shown in Table 1 appearing hereinafter.

EXAMPLE 6

Around the same iron core used in Example 1, a 13 mm-thick elastic layer 3 was formed by melt molding by use of a urethane thermoplastic elastomer (Miractran, mfd. by Nihon Polyurethane K.K.) so that the resultant elastic layer had a diameter of 31 mm, a length of 230 mm, and a rubber hardness of 12 degrees.

Then, a paint obtained by dispersing 10 parts of aluminum powder and 10 parts of a butyral resin (S-LEC BLS, mfd by Sekisui Kagaku K.K.) in 80 parts of methyl ethyl ketone was applied onto the elastic layer 3 by dip coating and then dried, thereby to form a 60 micron-thick electroconductive layer 4 on the elastic layer 3.

Further, a coating liquid obtained by dissolving 10 parts of ethyl cellulose in 90 parts of methanol was applied onto the electroconductive layer 4 by dip coating and dried to form thereon a 170 micron-thick resistance layer 5, whereby a primary charging roller No. 6 was prepared.

The thus prepared primary charging roller No. 6 was evaluated in the same manner as in Example 1. The results are shown in Table 1 appearing hereinafter.

EXAMPLE 7

Around the same iron core used in Example 1, a 11 mm-thick elastic layer 3 was formed by melt molding by use of a styrene-butadiene thermoplastic elastomer (Denka STR, mfd. by Denki Kagaku Kogyo K.K.) so that the resultant elastic layer had a diameter of 27 mm, a length of 230 mm, and a rubber hardness of 15 degrees.

Then, a paint obtained by dispersing 10 parts of $TiO_2$ powder and 10 parts of a butyral resin (S-LEC BLS, mfd. by Sekisui Kagaku K.K.) in 80 parts of methyl ethyl ketone was applied onto the elastic layer 3 by dip coating and then dried, thereby to form a 90 micron-thick electroconductive layer 4 on the elastic layer 3.

Further, a coating liquid obtained by dissolving 10 parts of nitrocellulose in 90 parts of methanol was applied onto the electroconductive layer 4 by dip coating and dried to form thereon a 60 micron-thick resistance layer 5, whereby a primary charging roller No. 7 was prepared.

The thus prepared primary charging roller No. 7 was evaluated in the same manner as in Example 1. The results are shown in Table 1 appearing hereinafter.

COMPARATIVE EXAMPLE 1

A primary charging roller No. 8 was prepared in the same manner as in the preparation of the primary charging roller No. 1 in Example 1, except that a resistance layer 5 was not formed.

The thus prepared primary charging roller No. 8 was evaluated in the same manner as in Example 1. The results are shown in Table 1 appearing hereinafter.

COMPARATIVE EXAMPLE 2

Around an iron core 2 having a diameter of 5 mm and a length of 250 mm, a 12.5 mm-thick elastic layer 3 was formed by melt molding by use of a mixture comprising 90 parts of EPDM rubber, 10 parts of electroconductive carbon (Ketjen Black, mfd. by Lion K.K.) and 5 parts of di(2-ethylhexyl)phthalate (DOP). The thus formed elastic layer 3 had a rubber hardness of 45 degrees and a volume resistivity of $9\times10^3$ ohm.cm.

Then, a coating liquid obtained by dispersing a mixture comprising 95 parts of EPDM rubber, 5 parts of electroconductive carbon (Ketjen Black, mfd. by Lion K.K.) and 5 parts of di(2-ethylhexyl)phthalate (DOP) in 400 parts of monochrolobenzene by means of a ball mill was applied onto the elastic layer 3 and then dried, thereby to form a 20 micron-thick electroconductive layer 4 on the elastic layer 3, whereby a primary charging roller No. 9 was prepared.

The thus prepared primary charging roller No. 9 was evaluated in the same manner as in Example 1. The results are shown in Table 1 appearing hereinafter.

COMPARATIVE EXAMPLE 3

A primary charging roller No. 10 was prepared in the same manner as in the preparation of the primary charging roller No. 9 in Comparative Example 2, except that an electroconductive layer 4 was not formed.

The thus prepared primary charging roller No. 10 was evaluated in the same manner as in Example 1. The results are shown in Table 1 appearing hereinafter.

TABLE 1

| | Charging member No. | Elastic layer | | Conductive layer | | Resistance layer | |
|---|---|---|---|---|---|---|---|
| | | Material/Thickness | Hardness | Material/Thickness | Volume resistivity (Ω · cm) | Material/Thickness | Volume resistivity (Ω · cm) |
| Example 1 | 1 | Chloroprene 12.5 mm | 15° | (Carbon + Urethane)*2 20 μm | $4\times10^4$ | Nylon-6*5 100 μm | $8\times10^{10}$ |
| 2 | 2 | Chloroprene 3 mm | 15° | (Carbon + Urethane)*2 20 μm | $4\times10^4$ | Nylon-6*5 100 μm | $8\times10^{10}$ |
| 3 | 3 | Chloroprene 12.5 mm | 35° | (Carbon + Urethane)*2 20 μm | $4\times10^4$ | Nylon-6*5 100 μm | $8\times10^{10}$ |
| 4 | 4 | Silicone 10 mm | 25° | (Carbon + Urethane)*2 1 mm | $4\times10^4$ | Nylon-6*6 100 μm | $5\times10^{10}$ |
| 5 | 5 | Silicone 10 mm | 25° | (Carbon + Urethane)*2 3 mm | $4\times10^4$ | Nylon-6*6 100 μm | $5\times10^{10}$ |
| 6 | 6 | Urethane elastomer 13 mm | 12° | (Al + Butyral)*3 60 μm | $9\times10^5$ | Ethyl cellulose 170 μm | $9\times10^9$ |
| 7 | 7 | Styrene-butadiene elastomer 11 mm | 15° | ($TiO_2$ + Butyral)*4 90 μm | $2\times10^5$ | Nitrocellulose 60 μm | $3\times10^9$ |

TABLE 1-continued

| | | | | | | |
|---|---|---|---|---|---|---|
| Comp. Example 1 | 8 | Chloroprene 12.5 mm | 15° | (Carbon + Urethane)*2 20 μm | $4 \times 10^4$ | — |
| 2 | 9 | (Carbon + EPDM)*1 12.5 mm | 45° | (Carbon + EPDM)*1 20 μm | $5 \times 10^5$ | — |
| 3 | 10 | (Carbon + EPDM)*1 12.5 mm | 45° | — | — | — |

| | Charging member No. | Dark part potential (−V) | Light part potential (−V) | Sound level (dB) | Image quality | Leak corr. to pin hole |
|---|---|---|---|---|---|---|
| Example 1 | 1 | 700 | 110 | 30 | Good | None |
| 2 | 2 | 700 | 110 | 39 | Good | None |
| 3 | 3 | 705 | 110 | 42 | Few white spots | None |
| 4 | 4 | 690 | 115 | 35 | Good | None |
| 5 | 5 | 695 | 115 | 40 | Few white spots | None |
| 6 | 6 | 705 | 105 | 28 | Good | None |
| 7 | 7 | 700 | 100 | 25 | Good | None |
| Comp. Example 1 | 8 | 690 | 105 | 30 | Many white spots | White dropping*7 |
| 2 | 9 | 650 | 105 | 50 | Many white spots | White dropping*7 |
| 3 | 10 | 520 | 120 | 55 | Many white spots | White dropping*7 |

*1EPDM containing DOP and carbon dispersed therein.
*2Urethane resin containing DOP and carbon dispersed therein.
*3Butyral resin containing Al powder dispersed therein.
*4Butyral resin containing $TiO_2$ powder dispersed therein.
*5Methoxymethylated nylon-6
*6Ethoxymethylated nylon-6
*7White dropping based on the leak occurred.

As apparent from the results shown in the above Table 1, the charging member according to the present invention provided good contact with the photosensitive member, provided good image quality without causing an image defect such as white spot based on charging unevenness. Further, the charging member according to the present invention caused no leak corresponding to a pin hole, and reduced the level of noise based on the AC voltage applied thereto.

On the contrary, in Comparative Examples 1 and 2 wherein the surface of the charging member comprised the electroconductive layer, the image defect based on charging unevenness occurred. Further, white dropping due to leak also occurred, because these charging members had no resistance layer. In the charging member of Comparative Example 2, the noise level based on the AC voltage application was high because the internal layer had a high rubber hardness.

In the charging member of Comparative Example 3, the charging ability was poor and an image defect occurred. Further, this charging member provided a high noise level because the surface thereof contacting the photosensitive member was hard. Moreover, this charging member provided white dropping based on the leak because it had no resistance layer.

EXAMPLE 8

A primary charging roller was prepared in the following manner.

Referring to FIG. 3, an elastic layer 3 and an electroconductive layer 4 were respectively formed on a substrate 2 in the same manner as in Example 1.

Then, a coating liquid obtained by dissolving 10 parts of ethyl cellulose and 1 part of di(2-ethylhexyl)phthalate (DOP) in 90 parts of methanol was applied onto the electroconductive layer 4 by dip coating and dried thereby to form a 80 micron-thick internal resistance layer 8. Further, a coating liquid for a surface resistance layer 9 obtained by mixing and dispersing 1 part of electroconductive carbon (Ketjen Black, mfd. by Lion K.K.), 19 parts of ethyl cellulose and 0.01 part of a surfactant (Sorbitol, mfd. by Ajinomoto K.K.) in 80 parts of methanol by means of a ball mill was applied onto the internal resistance layer 8 by spray coating and dried to form a 20 micron-thick surface resistance layer 9, whereby a primary charging roller No. 11 was prepared.

Separately, an internal resistance layer 8 and a surface resistance layer 9 were separately formed on an Al sheet by dip coating, respectively and the volume resistivity of each layer was measured.

The thus prepared primary charging roller No. 11 was evaluated in the same manner as in Example 1. The results are shown in Table 2 appearing hereinafter.

EXAMPLE 9

Around an ion core 2 having a diameter of 24 mm and a length of 250 mm, a 3 mm-thick elastic layer 3 was formed by melt molding by use of a chloroprene rubber so as to have a rubber hardness of 15 degrees. Then, an electroconductive layer 4 and an internal resistance layer 8 were successively formed on the elastic layer 3 in the same manner as in Example 8.

Further, a coating liquid for a surface resistance layer 9 obtained by mixing and dispersing 1 part of aluminum powder (Alpaste 54-137, mfd. by Toyo Aluminum K.K.), 19 parts of ethyl cellulose and 0.01 part of a surfactant (Solsperse, mfd. by I.C.I.) in 80 parts of ethanol by means of a ball mill was applied onto the internal resistance layer 8 by spray coating and dried to form a 20 micron-thick surface resistance layer 9, whereby a primary charging roller No. 12 was prepared.

The thus prepared primary charging roller No. 12 was evaluated in the same manner as in Example 1. The results are shown in Table 2 appearing hereinafter.

EXAMPLE 10

An elastic layer 3 and an electroconductive layer 4 were respectively formed on a substrate 2 in the same manner as in Example 1 except that the elastic layer 3 was formed so as to have a rubber hardness of 35 degrees.

Then, a coating liquid obtained by dissolving 10 parts of ethyl cellulose and 1 part of dibutylphthalate (DBP)

in 90 parts of methanol was applied onto the electroconductive layer 4 by dip coating and dried thereby to form a 80 micron-thick internal resistance layer 8. Further, a coating liquid for a surface resistance layer 9 obtained by mixing and dispersing 1 part of indium oxide powder (mfd. by Dowa Chemical K.K.) and 19 parts of nitrocellulose in 70 parts of methanol by means of a ball mill was applied onto the internal resistance layer 8 by spray coating and dried to form a 20 micron-thick surface resistance layer 9, whereby a primary charging roller No. 13 was prepared.

The thus prepared primary charging roller No. 13 was evaluated in the same manner as in Example 1. The results are shown in Table 2 appearing hereinafter.

EXAMPLE 11

An elastic layer 3 was formed on a substrate 2 in the same manner as in Example 1 except that the elastic layer 3 (rubber hardness: 25 degrees) was formed by using an EPDM rubber instead of the chloroprene rubber.

Then, a polyurethane paint containing electroconductive carbon particles dispersed therein (trade name: Sintron, mfd. by Shinto Toryo K.K.) was applied onto the elastic layer 3 by dip coating and then dried, thereby to form a 1 mm-thick electroconductive layer 4 on the elastic layer 3.

Further, a coating liquid obtained by dissolving 10 parts of an epichlorohydrin rubber (Hydrin, mfd. by Nihon Zeon K.K.), 1 part of tricresyl phosphate (TCP), 0.3 part of zinc oxide, 0.2 part of sulfur powder and 0.1 part of a vulcanization accelerator (trimercaptotriazine) in 90 parts of THF (tetrahydrofuran) was applied onto the electroconductive layer 4 by dip coating and dried to form thereon a 90 micron-thick internal resistance layer 8. Further, a coating liquid for a surface resistance layer 9 obtained by mixing and dispersing 1 part of electroconductive carbon (Ketjen Black, mfd. by Lion K.K.), 19 parts of methoxymethylated nylon-6 and 0.01 part of a surfactant (Sorbitol, mfd. by Ajinomoto K.K.) in 80 parts of methanol by means of a ball mill was applied onto the internal resistance layer 8 by spray coating and dried to form a 10 micron-thick surface resistance layer 9, whereby a primary charging roller No. 14 was prepared.

The thus prepared primary charging roller No. 14 was evaluated in the same manner as in Example 1. The results are shown in Table 2 appearing hereinafter.

EXAMPLE 12

A primary charging roller No. 15 was prepared in the same manner as in the preparation of the primary charging roller No. 14 in Example 11, except that an internal resistance layer 8 was formed by using epichlorohydrin-ethylene oxide rubber (Gechron, mfd. by Nihon Zeon K.K.) instead of the epichlorohydrin rubber.

The thus prepared primary charging roller No. 15 was evaluated in the same manner as in Example 1. The results are shown in Table 2 appearing hereinafter.

EXAMPLE 13

An elastic layer 3 and an electroconductive layer 4 were respectively formed on a substrate 2 in the same manner as in Example 6.

Then, a coating liquid obtained by dissolving 10 parts of polyester-polyol (Nippollan 4032, mfd. by Nihon Polyurethane Kogyo K.K.), 10 parts of isocyanate (Coronate 65, mfd. by Nihon Polyurethane K.K.), 1 part of di(2-ethylhexyl)phthalate (DOP), 0.3 parts of zinc powder, 0.2 part of sulfur powder and 0.1 part of a vulcanization accelerator (trimercaptotriazine) in 80 parts of MEK (methyl ethyl ketone) was applied onto the electroconductive layer 4 by dip coating and dried thereby to form a 95 micron-thick internal resistance layer 8 of polyurethane rubber. Further, a coating liquid for a surface resistance layer 9 obtained by mixing and dispersing 1 part of electroconductive carbon (Ketjen Black, mfd. by Lion K.K.) and 19 parts of nylon 6-66-10 (Amilan CM-8000, mfd. by Toray K.K.) in 80 parts of methanol by means of a ball mill was applied onto the internal resistance layer 8 by spray coating and dried to form a 5 micron-thick surface resistance layer 9, whereby a primary charging roller No. 16 was prepared.

The thus prepared primary charging roller No. 16 was evaluated in the same manner as in Example 1. The results are shown in Table 2 appearing hereinafter.

EXAMPLE 14

An elastic layer 3 was formed on a substrate 2 in the same manner as in Example 7. Then, a paint obtained by dispersing 10 parts of $TiO_2$ powder and a butyral resin (S-LEC BLS, mfd. by Sekisui Kagaku K.K.) in 80 parts of methyl ethyl ketone was applied onto the elastic layer 3 by dip coating and dried, thereby to form a 1.5 micron-thick electroconductive layer 4.

Then, a coating liquid obtained by dissolving 10 parts of nitrocellulose and 1 part of di(2-ethylhexyl)phthalate (DOP) in 90 parts of methanol was applied onto the electroconductive layer 4 by dip coating and dried thereby to form a 95 micron-thick internal resistance layer 8. Further, a coating liquid for a surface resistance layer 9 obtained by mixing and dispersing 1 part of titanium oxide powder (ECT-62, mfd. by Titan Kogyo K.K.) and 10 parts of nitro cellulose in 190 parts of methanol by means of a ball mill was applied onto the internal resistance layer 8 by spray coating and dried to form a 5 micron-thick surface resistance layer 9, whereby a primary charging roller No. 17 was prepared.

The thus prepared primary charging roller No. 17 was evaluated in the same manner as in Example 1. The results are shown in Table 2 appearing hereinafter.

EXAMPLE 15

An elastic layer 3 and an electroconductive layer 4 were respectively formed on a substrate 2 in the same manner as in Example 14.

Then, a coating liquid obtained by dissolving 10 parts of polyester-polyol (Nippollan 4032, mfd. by Nihon Polyurethane Kogyo K.K.), 10 parts of isocyanate (Coronate 65, mfd. by Nihon Polyurethanen K.K.), 1 part of di(2-ethylhexyl)phthalate (DOP), 0.3 parts of zinc powder, 0.2 part of sulfur powder and 0.1 part of a vulcanization accelerator in 80 parts of MEK (methyl ethyl ketone) was applied onto the electroconductive layer 4 by dip coating and dried thereby to form a 95 micron-thick internal resistance layer 8 of polyurethane rubber. Further, a coating liquid for a surface resistance layer 9 obtained by dissolving 10 parts of ethyl cellulose in 80 parts of methanol was applied onto the internal resistance layer 8 by spray coating and dried to form a 10 micron-thick surface resistance layer 9, whereby a primary charging roller No. 18 was prepared.

The thus prepared primary charging roller No. 18 was evaluated in the same manner as in Example 1. The results are shown in Table 2 appearing hereinafter.

TABLE 2

| | Charging member No. | Elastic layer Material/Thickness | Elastic layer Hardness | Conductive layer Material/Thickness | Conductive layer Volume resistivity (Ω · cm) | Internal resistance layer Material/Thickness | Internal resistance layer Tensile elasticity modulus (Kgf/mm²) | Internal resistance layer Volume resistivity (Ω · cm) |
|---|---|---|---|---|---|---|---|---|
| Example 8 | 11 | Chloroprene 12.5 mm | 15° | (Carbon + Urethane)*2 20 μm | $4 \times 10^4$ | Ethyl cellulose*8 80 μm | 89 | $8 \times 10^9$ |
| 9 | 12 | Chloroprene 3 mm | 15° | (Carbon + Urethane)*2 20 μm | $4 \times 10^4$ | Ethyl cellulose*8 80 μm | 89 | $8 \times 10^9$ |
| 10 | 13 | Chloroprene 12.5 mm | 35° | (Carbon + Urethane)*2 20 μm | $4 \times 10^4$ | Ethyl cellulose*8 80 μm | 92 | $8 \times 10^9$ |
| 11 | 14 | EPDM 12.5 mm | 25° | (Carbon + Urethane)*2 1 mm | $4 \times 10^4$ | Epichlorohydrin*9 90 μm | 30°*13 | $7 \times 10^9$ |
| 12 | 15 | EPDM 12.5 mm | 25° | (Carbon + Urethane) 1 mm | $4 \times 10^4$ | Epichlorohydrin-ethylene oxide*10 90 μm | 30°*13 | $5 \times 10^9$ |
| 13 | 16 | Urethane elastomer 13 mm | 12° | (Al + Butyral)*3 60 μm | $9 \times 10^5$ | Polyurethane*11 95 μm | 25°*13 | $5 \times 10^{10}$ |
| Example 14 | 17 | Styrene-butadiene elastomer 11 mm | 15° | ($TiO_2$ + Butyral)*4 1.5 mm | $2 \times 10^5$ | Nitrocellulose*12 95 μm | 130 | $3 \times 10^9$ |
| 15 | 18 | Styrene-butadiene elastomer 11 mm | 15° | ($TiO_2$ + Butyral)*4 1.5 mm | $2 \times 10^5$ | Polyurethane*11 90 μm | 25°*13 | $5 \times 10^{10}$ |

| | Charging member No. | Surface resistance layer Material/Thickness | Volume resisitivity (Ω · cm) | Dark part potential (−V) | Light part potential (−V) | Sound level (dB) | Image quality | Leak corr. to pin hole |
|---|---|---|---|---|---|---|---|---|
| Example 8 | 11 | (Carbon + Ethyl cellulose)*14 20 μm | $2 \times 10^9$ | 705 | 115 | 25 | Good | None |
| 9 | 12 | (Al + Ethyl cellulose)*15 20 μm | $2 \times 10^9$ | 700 | 110 | 28 | Good | None |
| 10 | 13 | (Indium oxide + Ethyl*16 cellulose) 20 μm | $3 \times 10^8$ | 700 | 115 | 40 | Few white spots | None |
| 11 | 14 | (Carbon + Nylon)*17 10 μm | $2 \times 10^9$ | 695 | 115 | 32 | Good | None |
| 12 | 15 | (Carbon + Nylon)*17 10 μm | $2 \times 10^9$ | 695 | 115 | 38 | Good | None |
| 13 | 16 | (Carbon + Nylon)*18 5 μm | $5 \times 10^{10}$ | 705 | 105 | 27 | Good | None |
| 14 | 17 | ($TiO_2$ + Nitrocellulose)*19 5 μm | $3 \times 10^8$ | 700 | 100 | 23 | Good | None |
| 15 | 18 | Ethyl cellulose 10 μm | $9 \times 10^9$ | 705 | 105 | 35 | Good | None |

*2Urethane resin containing carbon dispersed therein.
*3Butyral resin containing Al powder dispersed therein.
*4Butyral resin containing $TiO_2$ powder dispersed therein.
*8Ethyl cellulose containing DOP.
*9Epichlorohydrin rubber containing TCP.
*10Epichlorohydrin-ethylene oxide rubber containing TCP.
*11Polyurethane containing DOP.
*12Nitrocellulose containing DOP.
*13Represented by a rubber hardness.
*14Ethyl cellulose containing carbon dispersed therein.
*15Ethyl cellulose containing Al powder dispersion therein.
*16Ethyl cellulose containing indium oxide dispersed therein.
*17Methoxymethylated nylon containing carbon dispersed therein.
*18Nylon containing carbon dispersed therein.
*19Nitrocellulose containing $TiO_2$ powder dispersed therein.

As apparent from the results shown in the above Table 2, the charging member according to the present invention wherein the resistance layer was separated into two layers of an internal resistance layer 8 and a surface resistance layer 9, provided good image quality without causing an image defect. Further, the charging member according to the present invention caused no leak corresponding to a pin hole, and the level of noise based on the voltage applied thereto was reduced because the softness of the charging member was further enhanced by the presence of the internal resistance layer 8.

EXAMPLE 16

Charging members No. 9 to No. 18 were respectively left standing in the copying machine for two days without operation.

As a result, with respect to the charging members No. 9 and No. 10, the plasticizer contained in the surface layer thereof oozed out whereby the charging member adhered to the photosensitive member. Further, when the copying machine was driven for the purpose of copying, the adhesion portion of the photosensitive layer was peeled.

On the other hand, with respect to the charging members No. 11 to No. 18, none of these charging members adhered to the photosensitive member, whereby good copied images were provided.

What is claimed is:

1. A charging member having a surface capable of contact charging a charge-receiving member by surface contact comprising, in sequence:

an electroconductive substrate, an elastic layer, an electroconductive layer electrically connected to said electroconductive substrate and a resistance layer.

2. A member according to claim 1, wherein the elastic layer has a rubber hardness of 35 degrees or smaller.

3. A member according to claim 2, wherein the elastic layer has a rubber hardness of in the range of 12 to 25 degrees.

4. A member according to claim 1, wherein the elastic layer has a thickness of 1.5 mm or larger.

5. A member according to claim 4, wherein the elastic layer has a thickness in the thickness of 3 mm to 13 mm.

6. A member according to claim 1, wherein the elastic layer comprises a rubber or a thermoplastic elastomer.

7. A member according to claim 1, wherein the electroconductive layer has a volume resistivity of $10^7$ ohm.cm or lower.

8. A member according to claim 7, wherein the electroconductive layer has a volume resistivity of in the range of $10^{-2}$ ohm.cm to $10^6$ ohm.cm.

9. A member according to claim 1, wherein the electroconductive layer has a thickness of 3 mm or smaller.

10. A member according to claim 1, wherein the electroconductive layer has a thickness in the range of 20 microns to 1 mm.

11. A member according to claim 1, wherein the electroconductive layer comprises a resin containing electroconductive particles dispersed therein.

12. A member according to claim 1, wherein the resistance layer has a higher volume resistivity than that of the electroconductive layer.

13. A member according to claim 12, wherein the resistance layer has a higher volume resistivity than that of the electroconductive layer by a factor of one to six figures.

14. A member according to claim 1, wherein the resistance layer has a volume resistivity in the range of $10^6$ ohm.cm to $10^{12}$ ohm.cm.

15. A member according to claim 14, wherein the resistance layer has a volume resistivity in the range of $10^7$ ohm.cm to $10^{11}$ ohm.cm.

16. A member according to claim 1, wherein the resistance layer has a thickness in the range of 1 micron to 500 microns.

17. A member according to claim 16, wherein the resistance layer has a thickness in the range of 50 microns to 200 microns.

18. A member according to claim 1, wherein the resistance layer comprises a semiconductive resin, or an insulating resin containing electroconductive particles dispersed therein.

19. A member according to claim 18, wherein the resistance layer consists essentially of a resinous material comprising a semiconductive resin.

20. A member according to claim 1, wherein the elastic layer has a rubber hardness of 35 degrees or smaller and a thickness of 1.5 mm or larger; the electroconductive layer has a volume resistivity of $10^7$ ohm.cm or lower and a thickness of 3 mm or smaller; and the resistance layer has a thickness of 1 micron to 500 microns and a volume resistivity of $10^6$ ohm.cm to $10^{12}$ ohm.cm which is higher than the volume resistivity of the electroconductive layer.

21. A member according to claim 20, wherein the elastic layer has a rubber hardness of 12 to 25 degrees and a thickness of 3 mm to 13 mm; the electroconductive layer has a volume resistivity of $10^{-2}$ ohm.cm to $10^6$ ohm.cm and a thickness of 20 microns to 1 mm or smaller; and the resistance layer has a thickness of 50 microns to 200 microns and a volume resistivity of $10^7$ ohm.cm to $10^{11}$ ohm.cm.

22. A member according to claim 1, wherein the resistance layer has a two-layer structure comprising an internal resistance layer and a surface resistance layer.

23. A member according to claim 22, wherein the internal resistance layer contains a plasticizer.

24. A member according to claim 22, wherein the surface resistance layer contains electroconductive particles dispersed therein.

25. A member according to claim 22, wherein the surface resistance layer has a smaller thickness than that of the internal resistance layer.

26. A member according to claim 22, wherein the surface resistance layer has a lower volume resistivity than that of the internal resistance layer.

27. A member according to claim 22, wherein the internal resistance layer comprises a semiconductive rubber.

28. A member according to claim 22, wherein the surface resistance layer comprises a semiconductive resin, or an insulating resin containing electroconductive particles dispersed therein.

29. A member according to claim 1, wherein the elastic layer has a rubber hardness of 35 degrees or smaller and a thickness of 1.5 mm or larger; the electroconductive layer has a volume resistivity of $10^7$ ohm.cm or lower and a thickness of 3 mm or smaller; the resistance layer has a volume resistivity of $10^6$ ohm.cm to $10^{12}$ ohm.cm which is higher than that of the electroconductive layer, and the resistance layer has a two-layer structure comprising an internal resistance layer and a surface resistance layer wherein the internal resistance layer has a thickness of 1 micron to 450 microns and the surface resistance layer has a thickness of 0.1 micron to 50 microns.

30. A member according to claim 29, wherein the elastic layer has a rubber hardness of 12 to 25 degrees and a thickness of 3 to 13 mm; the electroconductive layer has a volume resistivity of $10^{-2}$ ohm.cm to $10^6$ ohm.cm and a thickness of 20 microns to 1 mm; the internal resistance layer has a thickness of 50 microns to 200 microns; the surface resistance layer has a thickness of 1 micron to 30 microns.

31. A member according to any one of claims 1 and 22, which is in the form of a roller.

32. A contact charging method, comprising:

providing a charging member having, in sequence, an electroconductive substrate; an elastic layer; an electroconductive layer electrically connected to said electroconductive substrate and a resistance layer;

providing a charge-receiving member disposed in contact with the charging member; and applying a voltage to the charging member by means of an external power supply, thereby to charge the charge-receiving member.

33. A contact charging method according to claim 32, including externally applying a pulsation voltage to the charging member to contact charge the charge receiving member, said pulsation voltage comprising a superposition of a DC voltage of ±200 V to ±1500 V and an AC voltage having a peak-to-peak voltage of 2000 V or below.

34. An electrophotographic apparatus, comprising:

a charging member which comprises, in sequence, an electroconductive substrate, an elastic layer, an electroconductive layer electrically connected to said electroconductive substrate and a resistance layer; and an electrophotographic photosensitive member disposed in contact with the charging member.

35. An apparatus according to claim 34, which further comprises image exposure means for exposing the photosensitive member to form a latent image; developing means for developing the latent image with a toner to form a transferable toner image on the surface of the photosensitive member, transfer charging means for transferring the toner image to a transfer-receiving material, and cleaning means for removing a residual toner; said charging member, image exposure means, developing means, transfer means and cleaning means being disposed in this order along the moving direction of the photosensitive member.

36. An apparatus according to claim 34, wherein the photosensitive member comprises an electroconductive substrate and a photosensitive layer disposed thereon comprising an organic photoconductor.

* * * * *

UNITED STATES PATENT AND TRADEMARK OFFICE

CERTIFICATE OF CORRECTION

PATENT NO. : 5,089,851

DATED : February 18, 1992

INVENTOR(S) : HISAMI TANAKA, ET AL.

It is certified that error appears in the above-identified patent and that said Letters Patent is hereby corrected as shown below:

Title page, item

[56] REFERENCES CITED

Under U.S. PATENT DOCUMENTS, insert:
--4,967,231 10/1990 Hosoya et al.--.

Under FOREIGN PATENT DOCUMENTS, insert:
--56-104351 8/81 Japan .
57-178267 11/82 Japan .
58-40566 3/83 Japan .
58-139156 8/83 Japan .
58-150975 9/83 Japan .--.

COLUMN 1

Line 14, "There" should read --These--.
Line 62, "prevent" should read --prevents--.

COLUMN 2

Line 34, "provide" should read --provides--.
Line 57, "in" should read --is--.

COLUMN 3

Line 9, "suerposition" should read --superposition--.
Line 33, "and" should be deleted.
Line 37, "abovementioned" should read --above-mentioned--.
Line 56, "cross sections" should read --cross-sections--.

COLUMN 4

Line 52, "be softened" should read --soften--.

UNITED STATES PATENT AND TRADEMARK OFFICE

CERTIFICATE OF CORRECTION

PATENT NO. : 5,089,851

DATED : February 18, 1992

INVENTOR(S) : HISAMI TANAKA, ET AL.

It is certified that error appears in the above-identified patent and that said Letters Patent is hereby corrected as shown below:

COLUMN 6

Line 1, "therein" should read --therein;--.
Line 18, "example" should read --examples--.
Line 28, "particle" should read --particles--.
Line 43, "particle" should read --particles--.
Line 61, "them" should read --than--.

COLUMN 8

Line 14, "epichlorohydrinethylene" should read --epichlorohydrin-ethylene--.

COLUMN 9

Line 52, "in digo" should read --indigo--.

COLUMN 10

Line 26, "are" should read --is--.
Line 34, "a" should be deleted.

COLUMN 11

Line 15, "preexpo-" should read --pre-expo- --.

COLUMN 12

Line 4, "tee" should read --the--.
Line 29, "which and" should read --and which--.

UNITED STATES PATENT AND TRADEMARK OFFICE

CERTIFICATE OF CORRECTION

PATENT NO. : 5,089,851

DATED : February 18, 1992

INVENTOR(S) : HISAMI TANAKA, ET AL.

It is certified that error appears in the above-identified patent and that said Letters Patent is hereby corrected as shown below:

COLUMN 15

Line 20, "mfd" should read --mfd.--.

COLUMN 16

Line 33, "monochrolobenzene" should read --monochlorobenzene--.

COLUMN 17

Line 26, "As" should read --As is--.
Line 29, "provided" should read --and provided--.

COLUMN 18

Line 41, "ion" should read --iron--.

COLUMN 20

Line 38, "nitro cellulose" should read --nitrocellulose--.
Line 55, "Polyurethanen" should read --Polyurethane--.

COLUMN 21

TABLE 2, "(Carbon + Urethane)" should read --(Carbon + Urethane)*2-- and "dispersion" should read --dispersed--.
Line 57, "As" should read --As is--.

UNITED STATES PATENT AND TRADEMARK OFFICE

CERTIFICATE OF CORRECTION

PATENT NO. : 5,089,851

DATED : February 18, 1992

INVENTOR(S) : HISAMI TANAKA, ET AL.

It is certified that error appears in the above-identified patent and that said Letters Patent is hereby corrected as shown below:

COLUMN 23

Line 11, "of" should be deleted.
Line 16, "thickness" (second occurrence) should read --range--.
Line 23, "of" should be deleted.

COLUMN 24

Line 37, "layer," should read --layer;--.
Line 49, "microns;" should read --microns; and--.
Line 57, "substrate" should read --substrate;--.
Line 66, "charge" (2nd occurrence) should read --charge- --.

COLUMN 25

Line 13, "image;" should read --image,--.

Signed and Sealed this

Third Day of August, 1993

Attest:

Michael K. Kirk

MICHAEL K. KIRK

Attesting Officer

Acting Commissioner of Patents and Trademarks